United States Patent [19]

Rice

[11] 4,165,070

[45] Aug. 21, 1979

[54] TORSION AND GRIPPING TYPE EXERCISE DEVICE FOR TOTAL ARM DEVELOPMENT

[76] Inventor: Max Rice, 120 MacDougal St., New York, N.Y. 10012

[21] Appl. No.: 860,293

[22] Filed: Dec. 14, 1977

[51] Int. Cl.[2] ..... A63B 21/30

[52] U.S. Cl. ..... 272/68; 272/67; 272/143; 272/140

[58] Field of Search ..... 272/122, 68, 67, 143, 272/123, 96; 104/246, 247, 248, 243; 46/17, 31

[56] References Cited

U.S. PATENT DOCUMENTS

| | | | |
|---|---|---|---|
| 860,847 | 7/1907 | Beecher | 104/247 X |
| 2,470,815 | 5/1949 | Harvey | 272/123 |
| 3,391,652 | 7/1968 | Lauber | 104/247 |

*Primary Examiner*—Richard C. Pinkham
*Assistant Examiner*—William R. Browne
*Attorney, Agent, or Firm*—Richard L. Miller

[57] ABSTRACT

An exercise apparatus which can be variously grasped while different torsion or other muscular movements are performed; the apparatus including a long hollow cylindrical bar having an enlarged circular handhold at each end, each handhold having an annular groove for receiving the fingers, a pair of spaced apart, short legs extending perpendicular to the bar, each outer end of the legs having a large circular foot which can alternately serve as handholds and a center of the bar having openings on opposite sides for the thumb and fingers of a user to permit squeezing of a sponge positioned in the center of the hollow bar.

1 Claim, 5 Drawing Figures

TORSION AND GRIPPING TYPE EXERCISE DEVICE FOR TOTAL ARM DEVELOPMENT

This invention relates generally to exercisers for purposes of muscular development.

A principle object of the present invention is to provide an exercise device which gives a total arm development.

Another object is to provide an exercise device which can be made for use by either adults or children so to promote good health and body-building to all.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
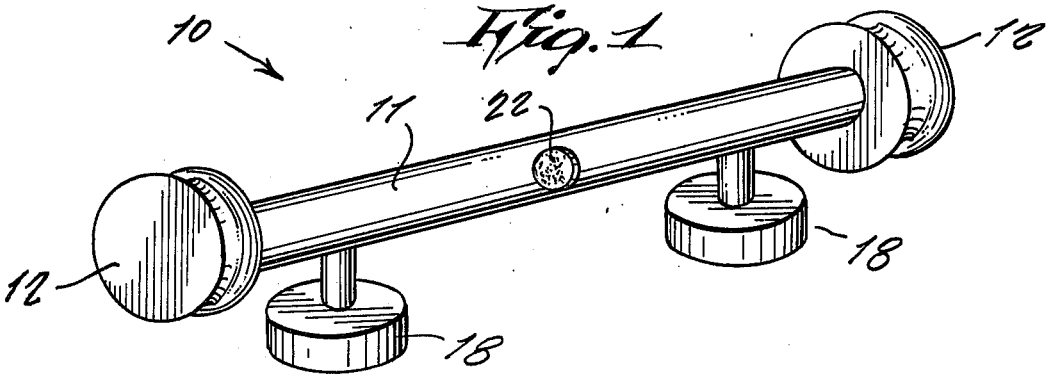

FIG. 1 is a perspective view of the invention.

Figure 2:
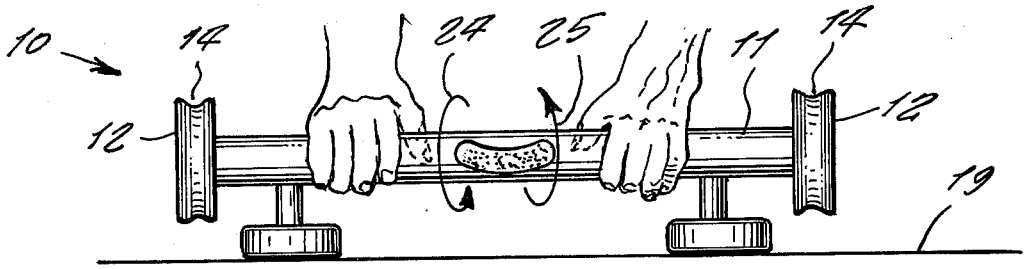
Figure 3:
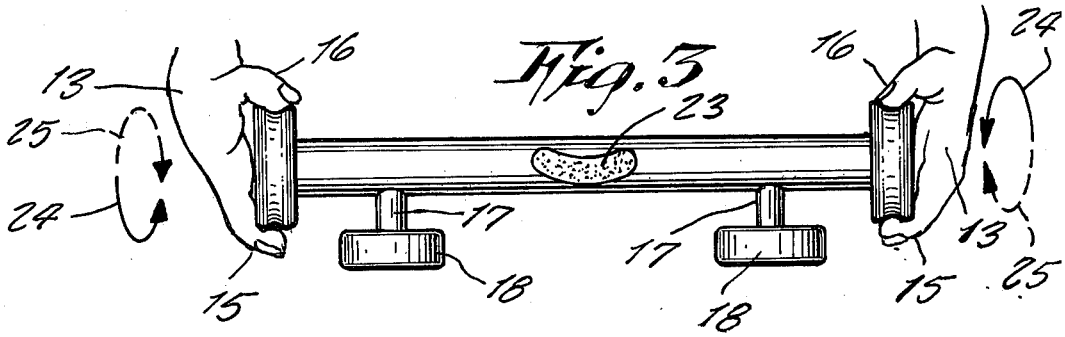
Figure 4:
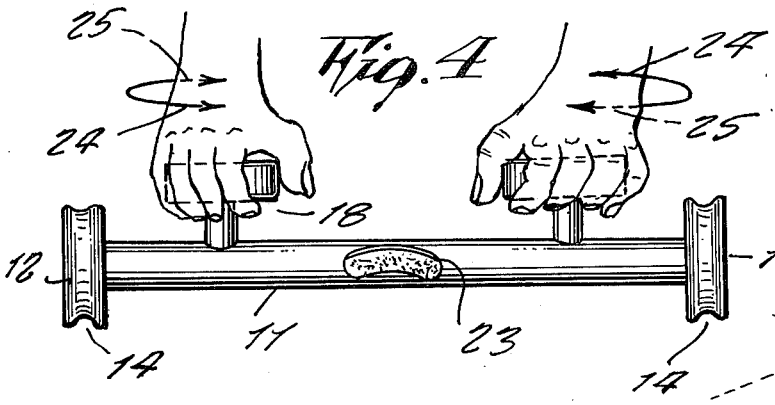

FIGS. 2, 3, and 4 are side views thereof showing different gripping exercises being performed thereupon.

Figure 5:
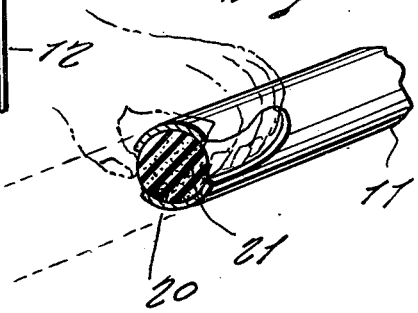

FIG. 5 is a fragmentary perspective view partly in cross section and illustrating the thumb and fingers inserted in openings on opposite side of the main crossbar so to squeeze a resilient core therewithin.

Referring now to the drawing in greater detail, the reference numeral 10 represents an exercise device for total arm development according to the present invention wherein there is an elongated, straight, cylindrical bar 11 which at its opposite ends has an enlarged, circular handhold 12 stationary therewith. Each handhold is of a size so that it can be comfortably grasped within a hand 13, as shown in FIG. 3; each handhold having an annual groove 14 for receiving the fingers 15 and thumb 16 therewithin.

Along a longitudinal side of the bar, there are a pair of parallel, spaced apart, short legs 17 extending perpendicular to the bar. Each outer end of the legs is integral with a circular foot 18 having a same diameter as handholds 12.

Thus, the feet serve either to support the device 10 upon a supporting surface 19, such as a floor, as shown in FIG. 2, or else serve as handholds, as shown in FIG. 3, for being grasped by the hands.

A longitudinal central portion of the bar is made hollow as shown at 20, and a resilient sponge or cushion

21 fills this interior. A circular hole 22 on one side of the bar, for receiving a thumb 16, and a crescent shaped slot 23 on an opposite side thereof for receiving the four fingers 15 when the hand grasps around the center of the bar, as shown in FIG. 5, so to squeeze the sponge.

The entire device is preferably made of a smooth-surfaced hard plastic material so to allow a firm or slidable grasp thereof, depending on the grasping force that is applied thereto.

The device with exception of the sponge, is entirely rigid with no moving part.

In the FIG. 2, the two hands, spaced apart, grasp around the circular bar.

As indicated by opposite extending arrows 24 and 25, in FIGS. 2, 3 and 4, the hands can apply an opposite direction force against the device so to develop various muscles of fingers, hands, wrists and entire arm.

It is thus apparent that the device may be used in at least the four ways as illustrated in the drawing. Additionally, it may be used with the bar in a vertical position, hands may be slided along the bar toward or away from each other, or the device may be used in numerous other ways as a person may discover for himself while exercising.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A flange exercise device for strengthening the grip and arm muscles, comprising in combination, an elongated, straight, cylindrical hollow bar, a circular handhold at each end of the bar, a pair of parallel, short legs along a side of said bar, and a circular foot at the end of each said legs, said handholds and said feet each being of a size for being conveniently grapsed within a hand; a peripheral edge of said handholds having an annular groove for receiving fingers and a thumb; said bar, handholds, legs and feet being of plastic and being made rigid respective to each other; and means including a circular hole on one side of said bar for receiving a thumb of a user and a crescent shaped slot on an opposite side thereof for fingers of a user to allow the thumb and fingers to squeeze a resilient sponge positioned inside the center of said bar.

* * * * *